US008657727B1

(12) United States Patent
Kassel et al.

(10) Patent No.: US 8,657,727 B1
(45) Date of Patent: Feb. 25, 2014

(54) RESISTANCE TRAINING EXERCISE DEVICE INCLUDING GOVERNOR

(75) Inventors: Blake Kassel, Boca Raton, FL (US); Shi dai Jin, Qingdao (CN)

(73) Assignee: Bodylastics International, Inc., Boca Raton, FL (US)

( * ) Notice: Subject to any disclaimer, the term of this patent is extended or adjusted under 35 U.S.C. 154(b) by 252 days.

(21) Appl. No.: 13/305,808

(22) Filed: Nov. 29, 2011

Related U.S. Application Data

(63) Continuation-in-part of application No. 12/928,786, filed on Dec. 20, 2010, which is a continuation-in-part of application No. 12/804,584, filed on Jul. 26, 2010, now abandoned, which is a continuation-in-part of application No. 12/546,085, filed on Aug. 24, 2009, now Pat. No. 7,819,787, which is a continuation-in-part of application No. 12/344,798, filed on Dec. 29, 2008, now Pat. No. 7,785,243.

(51) Int. Cl.
*A63B 21/02* (2006.01)
*A44B 11/25* (2006.01)

(52) U.S. Cl.
USPC ..... 482/122; 482/121; 482/126; 24/300

(58) Field of Classification Search
USPC ..... 482/121–122, 124, 126, 129, 904; 119/769–770, 792, 798; 24/300
See application file for complete search history.

(56) References Cited

U.S. PATENT DOCUMENTS

| | | | | |
|---|---|---|---|---|
| 1,112,114 | A | 9/1914 | Caines | |
| 1,538,845 | A * | 5/1925 | Titus | 482/126 |
| 2,930,614 | A | 3/1960 | McIntosh | |
| 4,815,731 | A * | 3/1989 | Suarez et al. | 482/124 |
| 5,052,365 | A | 10/1991 | Carella | |
| 5,167,601 | A | 12/1992 | Frappier | |
| 5,743,838 | A | 4/1998 | Willis | |
| 5,800,322 | A * | 9/1998 | Block | 482/126 |
| 5,807,218 | A | 9/1998 | Nagatomo | |
| 6,202,263 | B1 * | 3/2001 | Harker | 24/300 |
| 6,402,668 | B1 * | 6/2002 | Harker | 482/121 |
| 6,524,226 | B2 * | 2/2003 | Kushner | 482/126 |
| 6,692,415 | B1 * | 2/2004 | Winston | 482/126 |
| 6,860,841 | B1 * | 3/2005 | Mortorano | 482/126 |
| 6,979,286 | B1 * | 12/2005 | Hinds | 482/121 |
| 7,004,892 | B2 * | 2/2006 | Marco | 482/124 |
| 7,041,040 | B2 * | 5/2006 | Dovner et al. | 482/124 |
| 7,044,896 | B2 * | 5/2006 | Hetrick | 482/95 |
| 7,090,622 | B2 * | 8/2006 | Hetrick | 482/92 |
| 7,326,157 | B2 * | 2/2008 | Wu | 482/126 |
| 7,344,485 | B1 * | 3/2008 | Simpson et al. | 482/126 |
| 7,357,762 | B1 * | 4/2008 | Terry et al. | 482/126 |
| 7,418,926 | B2 * | 9/2008 | Kung | 119/798 |
| 7,448,990 | B2 * | 11/2008 | Wu | 482/121 |

(Continued)

*Primary Examiner* — Stephen Crow

(74) *Attorney, Agent, or Firm* — Caesar, Rivise, Bernstein, Cohen & Pokotilow, Ltd.

(57) ABSTRACT

A resistance training exercise device includes a stretchable cord having an internal cavity and a governor in the form of a limit band situated within that cavity and including first and second end segments. A retaining member attaches each of the end segments to the cord so as to impart stretching motion to the limit band when the cord is stretched during exercising. The retaining members provided at each end of the limit band each include a cup-shaped outer member and an inner, member having an outer peripheral surface. Each end segment of the limit band is positioned through an opening in the cup-shaped outer member and is secured to the inner member.

20 Claims, 6 Drawing Sheets

(56) References Cited

U.S. PATENT DOCUMENTS

| | | | | |
|---|---|---|---|---|
| 7,455,632 | B2 * | 11/2008 | Block et al. | 482/126 |
| 7,458,135 | B2 * | 12/2008 | Mikesell et al. | 24/300 |
| 7,503,883 | B2 * | 3/2009 | Madden | 482/126 |
| 7,695,413 | B1 | 4/2010 | Cruz et al. | |
| 7,727,131 | B2 | 6/2010 | Longo | |
| 7,785,243 | B2 | 8/2010 | Kassel | |
| 7,819,787 | B2 | 10/2010 | Kassel | |
| D639,355 | S * | 6/2011 | Kassel | D21/662 |
| D639,356 | S * | 6/2011 | Kassel | D21/662 |
| D643,886 | S * | 8/2011 | Kassel | D21/662 |
| D644,700 | S * | 9/2011 | Kassel | D21/662 |
| D688,193 | S * | 8/2013 | Beshears | D12/317 |
| 2003/0045408 | A1 | 3/2003 | Seles | |
| 2004/0180767 | A1 * | 9/2004 | Carmel et al. | 482/126 |
| 2005/0137066 | A1 * | 6/2005 | Wu | 482/126 |
| 2006/0073954 | A1 | 4/2006 | Block et al. | |
| 2007/0101950 | A1 * | 5/2007 | Medlin | 119/792 |
| 2007/0207904 | A1 | 9/2007 | Wu | |
| 2007/0232468 | A1 * | 10/2007 | Levy et al. | 482/121 |
| 2011/0224055 | A1 | 9/2011 | Kassel | |

* cited by examiner

RESISTANCE TRAINING EXERCISE DEVICE INCLUDING GOVERNOR

RELATED APPLICATIONS

This application is a continuation-in-part of application Ser. No. 12/928,786, filed on Dec. 20, 2010, which is a continuation-in-part of application Ser. No. 12/804,584, filed on Jul. 26, 2010 (abandoned), which is a continuation-in-part of application Ser. No. 12/546,085 filed on Aug. 24, 2009, now U.S. Pat. No. 7,819,787, which is a continuation-in-part of application Ser. No. 12/344,798, filed on Dec. 29, 2008, now U.S. Pat. No. 7,785,243.

BACKGROUND OF THE INVENTION

1. Field of the Invention

This invention relates generally to a resistance training exercise device, and more particularly, to a resistance training exercise device including a governor to limit the length of stretch of the device.

2. Description of Related Art

Resistance training is an extremely popular form of exercise; employing a variety of different devices. One of the more popular resistance training devices employs stretchable tubes or bands having a handles or other body securement means attached to opposed ends of the tube or band either directly or through attachment straps, carabineers and the like. To use this type of device, the user holds the handles or otherwise secures the tube to a part of the body to be exercised, and the user repeatedly stretches the tube to thereby increase the tension in the tube to provide resistance training.

One of the potential problems of concern is that the stretchable cord may break if stretched beyond its capacity. Such breakage can result in the cord snapping into contact with the user to cause serious bodily injury.

Prior art resistance training exercise devices including elastic cords also have attachment members, such as carabineers, to accommodate the attachment and use of a variety of different body engaging members, e.g., handles and straps thereto. Moreover, when exercising it is known to employ a number of elastic cords having varying levels of elasticity, to thereby change the workload imposed on the device during exercising.

It has been disclosed in prior art exercise cords to employ a non-destructive governor (i.e., restraining device) as part of the structure, to thereby limit the length of stretch of the outer cord for preventing the cord from breaking.

For example, an exercise band identified as "progym in a bag" is advertised on gofit.net, and includes a limit band inside of an outer, hollow, stretchable band. This device employs an outer, rigid plastic retaining member at each end for retaining a respective end of both the outer stretchable band and the inner limit band. Each of the outer members includes a base section that is internally threaded adjacent an open end thereof, and an plug section having external threads that cooperate with the threaded base section to permit the plug to be screwed into the base section. The opposed end of the plug includes a ring section to which a caribaneer, handle, etc. can be attached. An inner cup-shaped member is positioned in the base section of the outer retaining member below the upper threaded area of the base section to which the plug section is attached. The inner cup-shaped member has an opening in the base thereof through which the limit band is directed. The free end of the limit band is tied to a hollow, flat washer that has an outer diameter greater than the inner diameter of the cup-shaped member such that only a peripheral segment of the washer extends into the opening of the cup-shaped member, with a significant portion of the washer being outside the opening into the cup-shaped member. In this construction, the plug section is threaded into the base section to aid in preventing the washer from separating from the cup-shaped member; an action that otherwise could occur do to the fact that the washer only partially seats within the opening of the cup-shaped member. The construction of this latter exercise band is not well suited for use with a flexible tether, since it relies upon the use of the outer, rigid plastic retaining member to maintain the cup-shaped member and the washer in proper cooperation with each other. Moreover, the flat washer provides relatively sharp edges that engage the limit band in the region in which the washer and limit band are connected together and these edges can actually cut through or otherwise damage the limit band during use of the exercise band.

U.S. Pat. No. 7,819,787 also discloses a variety of different retaining devices for securing a governor within the interior of a hollow resistance training exercise device. However, none of these latter retaining devices employ an outer cup-shaped member cooperating with an inner retaining member.

Applicants believe that a need exists for improved retaining devices that can employ flexible tethers, that are economical to construct and that are less susceptible to breakage or damage than other such retaining devices. It is to such improved retaining devices that the present invention is directed.

The subject matter of U.S. Pat. No. 7,819,787 is incorporated by reference herein in its entirety. In addition, all of the other related applications/patents are incorporated by reference herein in their entirety.

SUMMARY OF THE INVENTION

A resistance training exercise device includes a stretchable cord having opposed first and second ends and includes an internal cavity. A flexible tether is secured adjacent each of the ends of the stretchable cord and each tether includes at least one compartment in which the first and second ends, respectively, of the cord are retained. A retaining member is provided within the internal cavity of the cord adjacent the first and second ends thereof, and this retaining member is located within the compartment of an adjacent tether. A sleeve is attached to the cord adjacent each of the first and second ends and at least a portion of the sleeve is located within the compartment of an adjacent tether. Each of the retaining members also is in the compartment of an adjacent tether and is located within a length of the sleeve that is located within the compartment of that adjacent tether.

A governor including a limit band is situated within the internal cavity of the stretchable band and includes opposed first and second end segments. These end segments are attached, respectively to the retaining members.

The retaining members in accordance with this invention aid in retaining the cord within the tethers and in retaining the opposed first and second end segments of the limit band attached to the cord so that the limit band moves, or stretches with the cord as the cord is being stretched during exercising; said limit band limiting the distance that the cord is capable of being stretched.

In accordance with the broadest aspects of this invention each of the retaining members includes a cup-shaped outer member and an inner member; preferably but not necessarily generally ball-shaped, located completely within the interior of the cup-shaped member. Each of the cup-shaped members includes a bottom wall and a peripheral wall, an outer surface of said peripheral wall engaging an inner surface of the cord and expanding the cord radially outwardly to assist in retaining the cord within the compartment of an adjacent tether. The bottom wall of each of the cup-shaped members has a passage through which a respective end segment of the limit band extends. Each of the end segments of the limit band is secured against movement to the inner member forming part of each of the retaining members, whereby the cup-shaped member cooperates with the inner member by supporting said inner member in a proper position within the interior of the cup-shaped member to assist in retaining the limit band in a proper position within the elastic cord and to insure that the limit band is expanded with the movement of the elastic cord.

In accordance with a preferred embodiment of this invention each of the retaining members includes a rigid, cup-shaped outer member and a rigid, inner member; preferably generally ball-shaped and having an outer peripheral surface free of sharp edges. Each of the cup-shaped members includes a bottom wall and a peripheral wall having an inner surface and an outer surface. The bottom wall of each of the cup-shaped members has a passage through which a respective end segment of the limit cord extends and the outer surface of the cup-shaped member engages the inner surface of the cord to expand the cord radially outwardly to assist in retaining the cord within the compartment of an adjacent tether. Each of the end segments of the limit band is secured against movement to the inner member forming part of each of the retaining members, said outer peripheral surface of the inner member of each of the retaining members being in tight frictional engagement with the inner surface of the peripheral wall of a respective cup-shaped member to thereby firmly retain the ball-shaped member and the end segment of the limit band secured thereto against relative movement to said stretchable cord when the cord is being stretched during exercising.

In a preferred embodiment of this invention the inner member is a generally ball-shaped, oblong member having a generally cylindrical central segment and opposed end segments, which preferably are rounded or curved. The central segment has an outer peripheral surface that provides frictional engagement with the inner surface of the peripheral wall of a respective cup-shaped member to firmly retain the generally ball-shaped member within the cup-shaped member to thereby prevent separation of the governor supported thereby and also to provide for the simultaneous movement of the governor with the elastic cord.

In the most preferred construction of this invention the inner member of each retaining member is a generally ball-shaped member including a channel in the outer peripheral surface thereof and each of the end segments of the limit band is retained within a channel of a respective ball-shaped member when secured to the respective ball-shaped member. Specifically, each of the end segments of the limit band is wrapped within the channel either once or multiple times; preferably twice, and most preferably is then knotted to itself to provide a firm attachment of the limit band to the ball-shaped member.

The firm attachment of the limit band to the inner member accompanied by the strong frictional engagement of the inner member within the outer cup-shaped member in the most preferred embodiments of this invention provide an extremely unique, simple and reliable attachment mechanism of the limit band to the elastic, stretchable cord that functions to cause the limit band to stretch with the cord until the limit band reaches it final level of elongation and to retain the cord connected to the tether.

In accordance with the broadest aspect of this invention the governor can be either an elastic or inelastic limit band. In either event, the governor needs to be sufficiently strong to prevent it from breaking when it reaches its stretched limit, and further needs to reach the stretched limit prior to the outer elastic band being stretched to such a high degree as to cause it to break or otherwise fail.

In the most preferred embodiment of this invention the governor is in the form of a multifilament polymer strand that is non-elastic; having a length that is multiple times (e.g., 4) greater than the relaxed length of the elastic cord. Any suitable polymer fibers can be employed to form the filament strand; most preferably Dyneema synthetic fibers. In the preferred embodiment of this invention the multifilament polymer strand is maintained in a crunched or collapsed condition within the interior of the exercise device prior to use.

Reference throughout this application to "generally ball-shaped" or "ball-shaped" in describing a part of the retaining member of this invention is intended to include both spherical and non-spherical constructions, unless specifically stated otherwise. In fact, in the preferred embodiment the ball-shaped member is generally oblong, as will be described in greater detail hereinafter.

Other objects and advantages of this invention will become apparent by referring to the description of the drawings which follows, taken in conjunction with the detailed description of this invention, which follows.

BRIEF DESCRIPTION OF THE DRAWINGS

The invention will be described in conjunction with the following drawings in which like reference numerals designate like elements and wherein.

DESCRIPTION OF THE INVENTION

Figure 1:
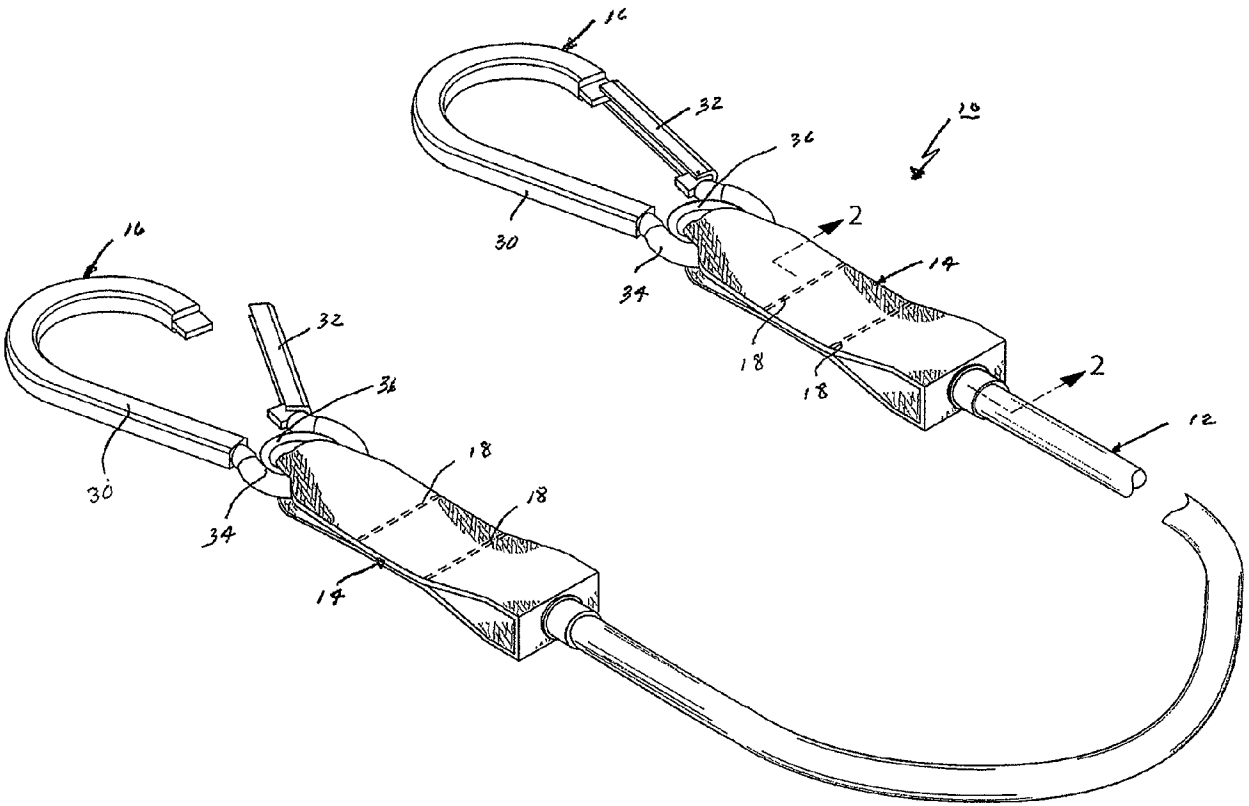
FIG. 1 is an isometric view of a representative resistance training exercise device employing a governor in accordance with this invention.

A resistance training exercise device employing the most preferred features of the present invention is generally indicated at 10 in FIG. 1. This device includes an elastic, elongated hollow cord 12 having tethers 14 secured to each end of the cord 12 and further including a clip or carabineer 16 secured to the free end of each of the tethers.

As can be seen best in FIG. 1, the preferred tether 14 is stitched at 18 to provide two compartments; one for receiving and retaining an adjacent end of the cord 12 and the other compartment for retaining the clip or carabineer 16. Each of the tethers 14 preferably is formed of a polymer, such as a nylon or nylon-like material that is secured to an adjacent end of the cord 12.

The elastic, elongated hollow cord 12 comprises a rubber or rubber-like material having a predetermined level of elasticity corresponding to the amount of pulling force needed to stretch the cord a desired distance. The level of elastic resistance in the cord dictates the tension force of the cord, which is represented in pounds. Accordingly, the cord 12 is designed with an average workout weight in pounds based on the cord's modulus of elasticity, which can be indicated on the cord's corresponding clip 16 if desired.

It should be understood that the clips or carabineers 16 are employed for attaching a variety of different body engaging members thereto, such as a handles, an ankle or wrist straps, a ropes, bars, etc.

Figure 2:
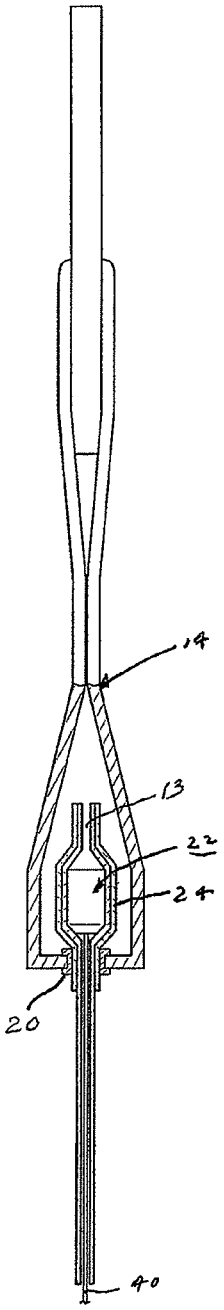
FIG. 2 is a view along line 2-2 of FIG. 1, partially in section, showing certain details of construction in accordance with this invention.
Figure 3:
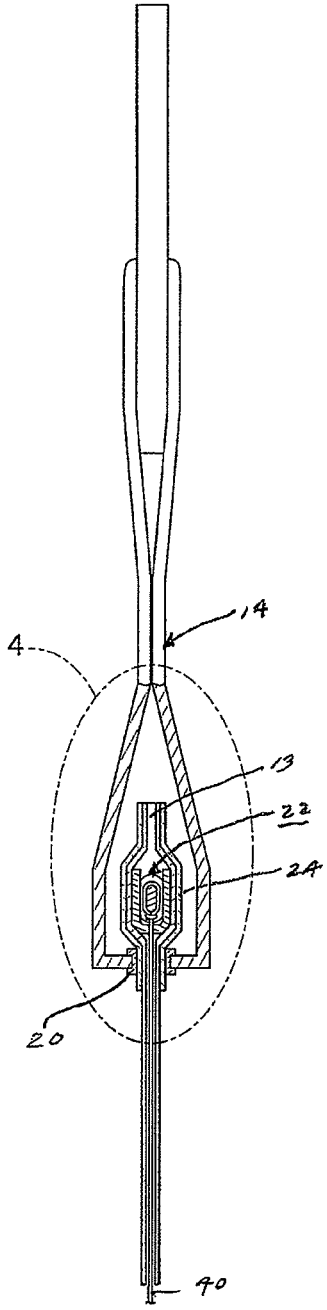
FIG. 3 is a sectional view similar to that shown in FIG. 2, but with additional parts in section to show details of construction of the unique retaining member in accordance with the most preferred embodiment of this invention.

Referring to FIGS. 1-3, the tethers 14 are each secured to a respective, adjacent end of the cord 12 by a grommet 20, retaining member 22 and strain release sleeve 24. The retaining member 22 is inserted into hollow passage 13 at each end of the cord 12 and functions, in part, to block the grommet 20 from slipping off of the cord 12. The strain relief sleeve 24 fits tightly over each end of the cord 12 that contain the retaining member 22 to thereby reinforce the cord 12 and retaining member 22 to thereby increase the stress and strain tolerance of the cord. The sleeve 24 preferably comprises an elastic sleeve member that stretches and mounts over the opposed ends of the cord that contain the retaining member 22. The elastic sleeve members 24 stretch and conform to the shape of the retaining member 22 to reinforce and increase the tolerance level of stress, strain and/or shearing forces.

In an alternative embodiment the strain relief sleeve 24, instead of being a separate member, may be formed or provided by a portion of the elastic cord 12 that is folded back over itself to surround the region of the cord including the retaining member 22 therein.

Referring specifically to FIG. 1 it should be noted that clip 16 can be of any conventional design and, in the illustrated embodiment, includes a hooked body 30, a spring loaded or biasing member 32 and a smaller, tether connecting end 34. In the illustrated embodiment an O-ring 36 is provided in the smaller tether connecting end 34 of the clip 16 to receive the tether end for reinforcement and smooth support of the tether 14 in a manner that reduces friction and the risk of damage to the tether during exercising. Access to the opening in the clip 16 is controlled by the biasing member 32, which facilitates the clipping of a body engaging member (e.g., a handle or strap) to the clip.

It should be noted that the various features of the resistance training exercise device 10 described thus far are disclosed in detail in U.S. Pat. No. 7,819,787, previously incorporated by reference herein and assigned to the assignee of the present application.

Turning specifically to FIGS. 2-5, the resistance training exercise device 10 includes a governor in the form of a limit band 40 housed within the elastic cord 12 and secured to each end of the cord 12 by retaining members 22. The governor 40 limits the stretching of the cord 12 to a predetermined length to prevent the cord 12 from breaking. The limit band 40 can be of any desired construction, and can be made of a semi-elastic material having substantially less elasticity than the elastic cord 12 or, in the most preferred embodiment, is substantially inelastic. In the preferred embodiment of this invention, the limit band 40 is a multi-filament polymer strand, most preferably made from Dyneema synthetic fibers.

Due to the fact that the preferred limit band 40 is inelastic and has a length multiple times greater than the relaxed length of the hollow cord (e.g. 4 times greater) it is retained within the interior passage 13 of the hollow cord 12 in a crunched or bunched-up condition.

It should be noted that the limit band 40 has a higher tensile strength than the elastic cord 12 to thereby stop the cord from stretching without the limit band breaking. Although the limit band 40 may have some elasticity, in the most preferred embodiment of this invention it is inelastic and is crunched or bunched up in the cord when the cord is in a relaxed condition.

Figure 4:
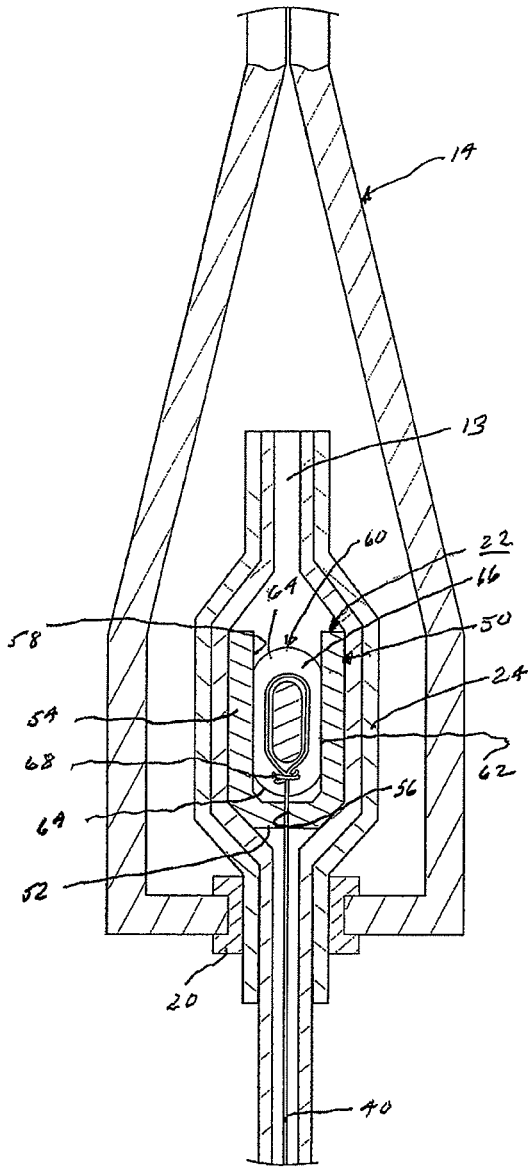
FIG. 4 is an enlarged view of the circled area identified as "4" in FIG. 3.
Figure 5:
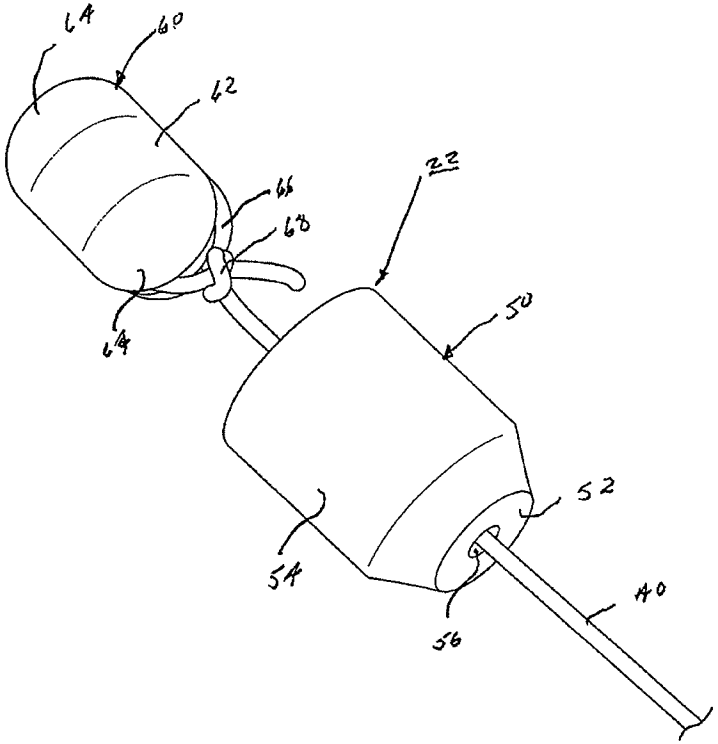
FIG. 5 is an exploded isometric view showing details of construction of the preferred retaining member in accordance with this invention.

As can be seen best in FIGS. 4 and 5, the most preferred retaining member 22 of this invention is of a unique construction including a rigid cup-shaped outer member 50 including a bottom wall 52 and a peripheral side wall 54. The cup-shaped member includes an opening or passage 56 in the bottom wall through which limit band 40 extends. In accordance with the preferred embodiments of this invention the cup-shaped member 50 can be made of any desired rigid material, e.g., plastic, hard rubber, etc. and most preferably is made from a polyolefin, such as polypropylene.

As can be seen best in FIGS. 2-4, the peripheral side wall 54 of the outer member also includes an inner surface 58, and a rigid inner member; preferably a substantially ball-shaped member 60, is forced into tight frictional engagement with said inner surface. Although this is the most preferred arrangement in accordance with the broadest aspects of this invention the inner member may not be in tight frictional engagement with the inner surface of the cup-shaped member.

As can be seen best in FIGS. 4 and 5, in the most preferred embodiment of this invention the substantially ball-shaped member 60 preferably is of a generally oblong configuration including a central cylindrical section 62 and opposed rounded sections 64. A channel 66 is provided in the outer periphery of the ball-shaped member 60, preferably extending continuously about the entire periphery thereof. The ball-shaped member can be made of any suitable material; most preferably of the same material employed to make the cup-shaped member 50.

As can be seen best in FIGS. 4 and 5, the governor, in the form of a multi-filament limit band 40, is positioned through the passage 56 in the bottom wall of the cup-shaped outer member, is wrapped tightly about the ball-shaped member 60 in the channel 66 thereof, and is then tied or knotted to itself, as indicated at 68. The ball-shaped member 60 with the limit band 40 secured thereto is then forced into the opening in the cup-shaped member 50 to provide a tight frictional engagement between the outer peripheral wall of the cylindrical section 62 of the ball-shaped member 60 and the inner surface 58 of the side wall 54 of the cup-shaped outer member 50.

The provision of the channel 66 in the ball-shaped member 60 in accordance with the most preferred embodiment of this invention permits the limit band 40 to be wrapped about the ball-shaped member without interfering with the ability to provide tight frictional engagement between the outer periphery of the cylindrical section 62 of the ball-shaped member and the inner surface of the side wall 54 of the cup-shaped outer member 50. With this arrangement the likelihood of damaging the limit band as a result of frictional rubbing engagement with the inner surface of the cup-shaped outer member is minimized, as compared to simply wrapping the limit band about an un-channeled surface of the inner retaining member 60.

The tight connection of the limit band 40 with the substantially ball-shaped member 60 in combination with the additional tight frictional engagement of the ball-shaped member 60 with the inner surface 58 of the side wall 54 of the cup-shaped member 50 provides an extremely reliable connection between the limit band 40 and the elastic, elongated hollow cord 12.

Although the inner member 60 preferably is a ball-shaped member as described in detail above, it is within the broadest aspects of this invention to employ an inner member of other shapes and constructions.

Figure 7:
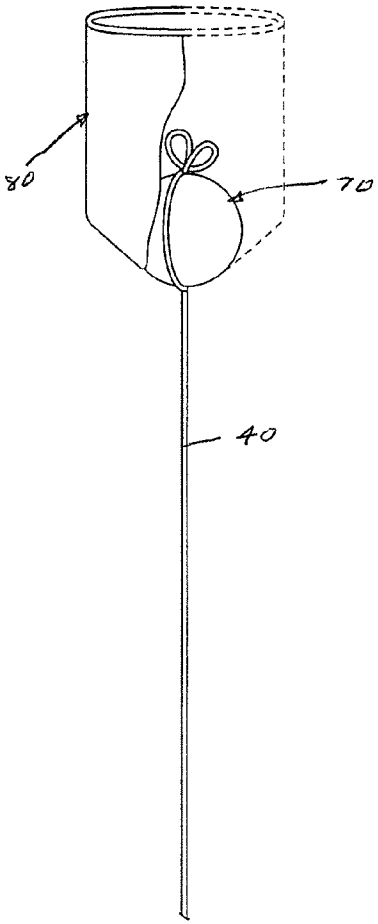
FIG. 7 is an isometric view with the cup-shaped member partially broken away showing the manner in which the inner member illustrated in FIG. 6 cooperates with an outer cup-shaped member to provide a retaining member in accordance an embodiment of this invention.
Figure 6:
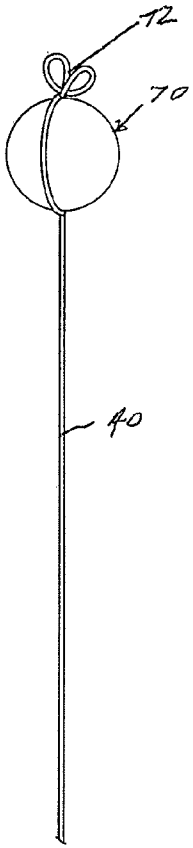
FIG. 6 is an elevational view showing a limit band attached to an inner member of a retaining member in accordance with an additional embodiment of this invention.

For example, referring to FIGS. 6 and 7, an inner member 70 of a retaining member can be completely spherical and have a continuous, outer surface free of any channel for receiving the limit band 40 therein. In this embodiment, one of the end segments of the limit band 40 is wrapped about the outer periphery of the inner member and than knotted to itself at 72. The inner spherical member 70, with the limit band 40 secured about the periphery thereof, is then retained within outer, cup-shaped member 80 (FIG. 7), which can be of the same construction as the outer cup-shaped member 50 of the preferred embodiment of this invention. In accordance with the broadest aspects of this invention the inner member 70 may not need to be maintained in frictional engagement with the inner surface of the cup-shaped member 80, although in the most preferred embodiment of the invention a tight frictional engagement is maintained.

It should be noted that features of the embodiment shown in FIGS. 6 and 7, as described above, are the same as in the embodiment shown in FIGS. 27 and 28 of parent application Ser. No. 12/928,786, the subject matter of which already has been incorporated by reference herein and constitutes the joint invention of the inventors specified herein.

Figure 8:
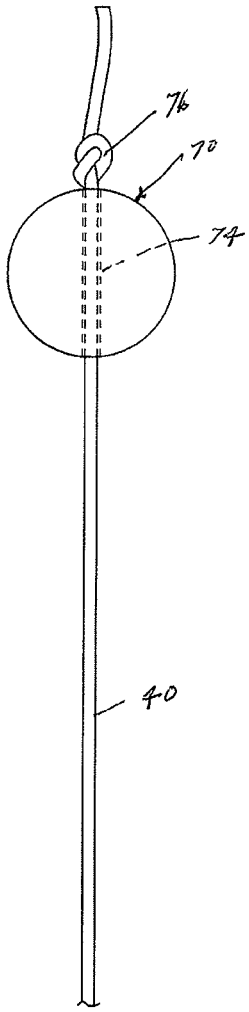
FIG. 8 is an end elevational view showing a limit band attached to an inner member of a retaining member in accordance with still an additional embodiment of this invention.

Referring to FIG. 8, as an alternative to wrapping the limit band about the outer periphery of the spherical member 70, as shown in FIGS. 6 and 7, a central passage 74 can be provided diametrically through the spherical member 70 for receiving an end segment of the limit band. In this latter embodiment the distal end of the end segment, after passing through the central passage, is knotted to itself at 76 to retain the limit band within the spherical member. Thereafter, the spherical member 70 is then inserted into the cup-shaped member 80. As in all of the previously discussed embodiments, although in accordance with the broadest aspects of this invention the inner spherical member 70 may not be maintained in tight frictional engagement with the inner surface of the cup-shaped member 80, in the most preferred embodiment such a tight frictional engagement is maintained to provide an extremely rigid and reliable retaining member construction.

Also, in accordance with the broadest aspects of this invention the cup-shaped members 50, 80 can have a variety of different configurations, e.g., spherical, cone-shaped, tapered, etc.; the configuration not being limited to a configuration employing a flat bottom wall and a cylindrical side wall. The important feature is that the cup shaped member be capable of housing an inner retaining member therein; preferably frictionally engaging the inner retaining member to which the limit band is attached.

While the invention has been described in detail and with reference to specific examples thereof, it will be apparent to those skilled in the art that various changes and modifications can be made therein without departing from the spirit and scope thereof.

What is claimed is:

1. An exercise device comprising:

a stretchable cord having opposing first and second ends, said cord having an internal cavity and an external surface;

a flexible tether adjacent each of said first and second ends, each of said tethers including a compartment in which said first and second ends, respectively, of said cord are retained;

a retaining member within said internal cavity adjacent each of said first and second ends and being located within the compartment of an adjacent tether;

a sleeve attached to said cord adjacent each of said first and second ends, at least a portion of said sleeve being within the compartment of an adjacent tether, each of said retaining members being in the compartment of an adjacent tether and being located within a length of said sleeve located within said compartment of said adjacent tether;

a governor including a limit band situated within the internal cavity of said stretchable cord and including opposed, first and second end segments;

said retaining members aiding in retaining the cord within the tethers and in retaining the opposed first and second end segments of the limit band in a position within the cord to stretch or move with the cord as said cord is being stretched during exercising, said limit band limiting the distance that the cord can be stretched;

said retaining members each including a cup-shaped outer member and an inner member having an outer peripheral surface, each of said cup-shaped members having a peripheral wall having an inner surface and a passage through which a respective end segment of the limit band extends; each of said end segments of the limit band being secured against movement to the inner member of a respective retaining member, said inner member of each of said retaining members being retained completely within an inner compartment of a respective cup-shaped member for maintaining said inner member in proper position to move with said cord, said cup-shaped member engaging said cord to expand the cord outwardly and thereby aid in retaining the limit band secured for movement with the cord.

2. The exercise device of claim 1, wherein said inner member is generally ball-shaped.

3. The exercise device of claim 2, wherein said cup-shaped member and said ball-shaped member are rigid, said outer peripheral surface of the ball-shaped member being in frictional engagement with the inner surface of the peripheral wall of a respective cup-shaped member to firmly retain the ball-shaped member and the end segment of the limit band secured thereto against relative movement to said stretchable cord when the cord is being stretched during exercising.

4. The exercise device of claim 3, wherein said generally ball-shaped member of each retaining member is substantially oblong having a generally cylindrical central segment and opposed end segments, said central segment having an outer peripheral surface providing frictional engagement with the inner surface of the peripheral wall of a respective cup-shaped member.

5. The exercise device of claim 2, wherein said generally ball-shaped member of each of said retaining members includes a channel in said outer peripheral surface thereof, each of said end segments of said limit band being retained within a channel of a respective ball-shaped member when secured to said respective ball-shaped member.

6. The exercise device of claim 5, wherein said cup-shaped member and said ball-shaped member are rigid, said outer peripheral surface of the ball-shaped member being in frictional engagement with the inner surface of the peripheral wall of a respective cup-shaped member to firmly retain the ball-shaped member and the end segment of the limit band secured thereto against relative movement to said stretchable cord when the cord is being stretched during exercising.

7. The exercise device of claim 2, wherein said generally ball-shaped member of each of said retaining members includes a channel in said outer peripheral surface thereof, each of said end segments of said limit band being retained within a channel of a respective ball-shaped member when secured to said respective ball-shaped member by being wrapped multiple times about said respective ball-shaped member within said channel.

8. The exercise device of claim 7, wherein said cup-shaped member and said ball-shaped member are rigid, said outer peripheral surface of the ball-shaped member being in frictional engagement with the inner surface of the peripheral wall of a respective cup-shaped member to firmly retain the ball-shaped member and the end segment of the limit band secured thereto against relative movement to said stretchable cord when the cord is being stretched during exercising.

9. The exercise device of claim 3, wherein said generally ball-shaped member of each of said retaining members includes a channel in said outer peripheral surface thereof, each of said end segments of said limit band being retained within a channel of a respective ball-shaped member when secured to said respective ball-shaped member by being wrapped multiple times about said respective ball-shaped member within said channel and then knotted to said limit band.

10. The exercise device of claim 3, wherein said generally ball-shaped member of each retaining member is substantially oblong having a generally cylindrical central segment and opposed end segments, said central segment having an outer peripheral surface providing frictional engagement with the inner surface of the peripheral wall of a respective cup-shaped member, wherein said substantially oblong member includes a channel in said outer peripheral surface of both said central segment and opposed end segments thereof, each of said end segments of said limit band being retained within a channel of a respective ball-shaped, oblong member when secured to said respective ball-shaped, oblong member.

11. The exercise device of claim 3, wherein said generally ball-shaped member of each retaining member is substantially oblong having a generally cylindrical central segment and opposed end segments, said central segment having an outer peripheral surface providing frictional engagement with the inner surface of the peripheral wall of a respective cup-shaped member, wherein said substantially oblong member includes a channel in said outer peripheral surface of both said central segment and opposed end segments thereof, each of said end segments of said limit band being retained within a channel of a respective ball-shaped, oblong member when secured to said respective ball-shaped, oblong member by being wrapped multiple times about said respective ball shaped, oblong member within said channel.

12. The exercise device of claim 3, wherein said generally ball-shaped member of each retaining member is substantially oblong having a generally cylindrical central segment and opposed end segments, said central segment having an outer peripheral surface providing frictional engagement with the inner surface of the peripheral wall of a respective cup-shaped member, wherein said substantially oblong member includes a channel in said outer peripheral surface of both said central segment and opposed end segments thereof, each of said end segments of said limit band being retained within a channel of a respective ball-shaped, oblong member when secured to said respective ball-shaped, oblong member by being wrapped multiple times about said respective ball shaped, oblong member within said channel and then knotted to said limit band.

13. The exercise device of claim 3, wherein said limit band of said governor is substantially non-elastic and is in a retracted, crunched condition within said stretchable cord when said cord is in an unstretched condition, said cord being elastically stretchable to a length at which the limit band is in a fully extended condition.

14. The exercise device of claim 13, wherein said limit band of said governor is a multifilament polymer strand.

15. The exercise device of claim 4, wherein said limit band of said governor is substantially non-elastic and is in a retracted, crunched condition within said stretchable cord when said cord is in an unstretched condition, said cord being elastically stretchable to a length at which the limit band is in a fully extended condition.

16. The exercise device of claim 15, wherein said limit band of said governor is a multifilament polymer strand.

17. The exercise device of claim 6, wherein said limit band of said governor is substantially non-elastic and is in a retracted, crunched condition within said stretchable cord when said cord is in an unstretched condition, said cord being elastically stretchable to a length at which the limit band is in a fully extended condition.

18. The exercise device of claim 17, wherein said limit band of said governor is a multifilament polymer strand.

19. The exercise device of claim 8, wherein said limit band of said governor is substantially non-elastic and is in a retracted, crunched condition within said stretchable cord when said cord is in an unstretched condition, said cord being elastically stretchable to a length at which the limit band is in a fully extended condition.

20. The exercise device of claim 9, wherein said limit band of said governor is substantially non-elastic and is in a retracted, crunched condition within said stretchable cord when said cord is in an unstretched condition, said cord being elastically stretchable to a length at which the limit band is in a fully extended condition.

* * * * *